United States Patent [19]

Stepe

[11] 4,290,214

[45] Sep. 22, 1981

[54] EARTHWORKING IMPLEMENT SIDE PLATE WEAR MEMBER

[75] Inventor: Visvaldis A. Stepe, Willow Springs, Ill.

[73] Assignee: Caterpillar Tractor Co., Peoria, Ill.

[21] Appl. No.: 150,869

[22] Filed: Feb. 4, 1980

[51] Int. Cl.[3] ..... E02F 9/28

[52] U.S. Cl. ..... 37/141 T; 172/701.2

[58] Field of Search ..... 37/141 R, 141 T, 142 R, 37/142 A; 172/701.2, 701.3

[56] References Cited

U.S. PATENT DOCUMENTS

| | | | |
|---|---|---|---|
| 1,856,930 | 5/1932 | Robin | 37/142 R |
| 3,088,232 | 5/1963 | Gilbertson | 37/141 R |
| 3,643,357 | 2/1972 | Benning et al. | 37/141 R |
| 3,736,675 | 6/1973 | Shankwitz et al. | 37/141 R |
| 3,839,806 | 10/1974 | Hood | 37/142 R |
| 3,961,788 | 6/1976 | Helton et al. | 37/141 T X |
| 3,967,398 | 7/1976 | Stepe | 37/141 R |
| 3,984,928 | 10/1976 | Oke et al. | 37/141 R |
| 4,007,550 | 2/1977 | Stepe | 37/142 R |
| 4,055,223 | 10/1977 | Lasey et al. | 37/141 T X |
| 4,071,967 | 2/1978 | Klett | 37/141 T |

FOREIGN PATENT DOCUMENTS

| | | | |
|---|---|---|---|
| 2237734 | 3/1973 | Fed. Rep. of Germany | 37/141 R |

*Primary Examiner*—E. H. Eickholt

*Attorney, Agent, or Firm*—Charles L. Rowe

[57] ABSTRACT

An improved wear member for use in an earthworking implement having a sidewall member defining a bottom edge portion to which the wear member is secured is disclosed. The wear member comprises a U-section member defining a bottom bight portion and spaced legs defining a channel receiving the lower end of the sidewall member.

18 Claims, 8 Drawing Figures

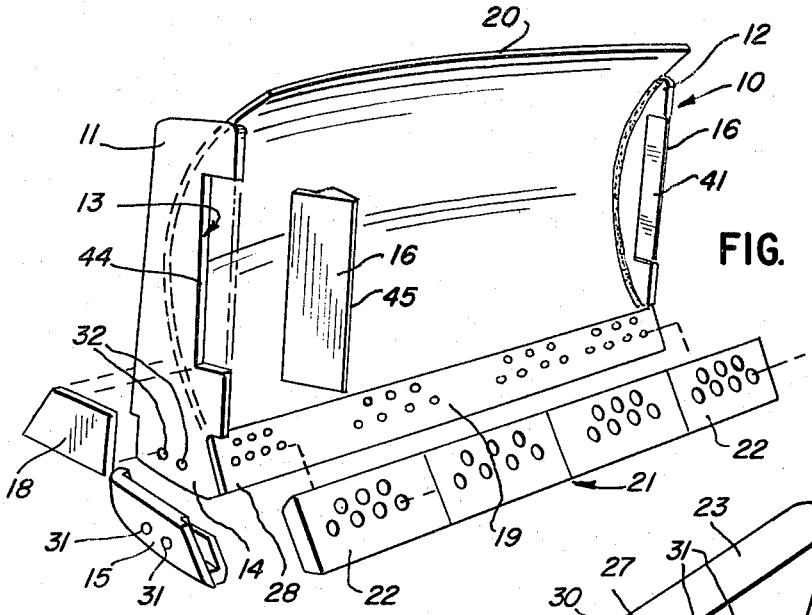
FIG. 1
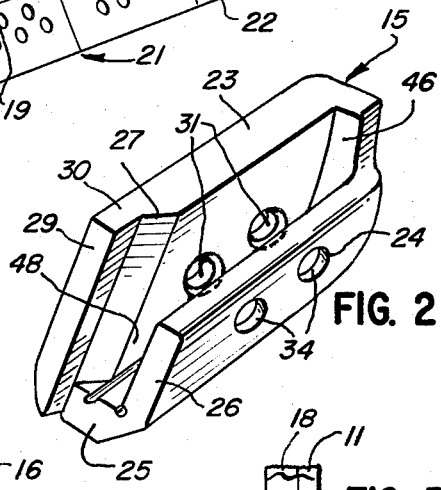
FIG. 2
FIG. 3
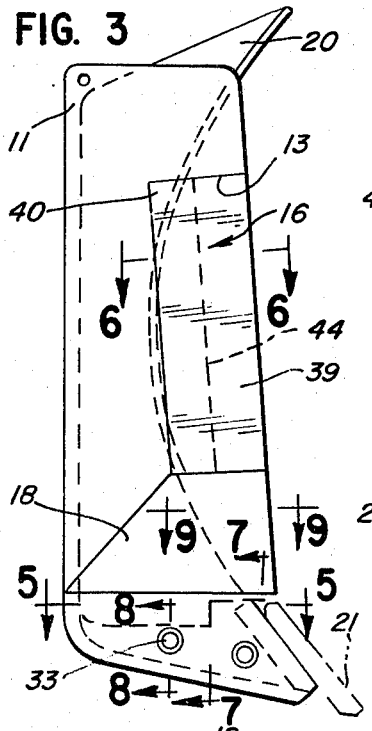
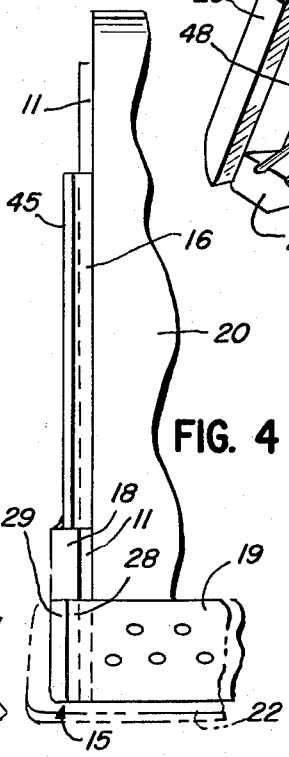
FIG. 4
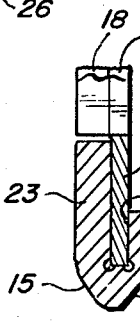
FIG. 7
FIG. 5
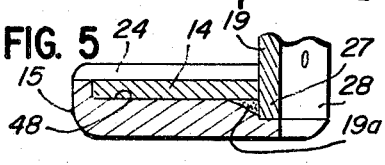
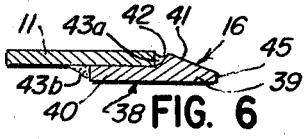
FIG. 6
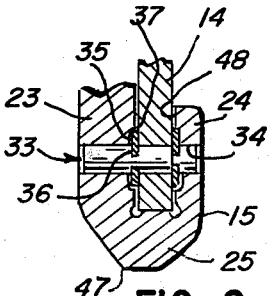
FIG. 8

EARTHWORKING IMPLEMENT SIDE PLATE WEAR MEMBER

DESCRIPTION

1. Technical Field

This invention relates to earthworking implements and in particular to wear members for use therein.

2. Background Art

In one conventional form of earthworking implement, such as a bulldozer blade or loader bucket, a pair of sidewalls are provided at the opposite ends of the moldboard. A bit support extends across the bottom of the moldboard and has its opposite ends secured to end plates. Suitable removable bits are mounted to the bit support with replaceable end bits overlapping the end plates.

A number of devices have been developed for protecting the lower corners of the implement assembly. Illustratively, in U.S. Pat. No. 3,967,398 of applicant herein, which patent is owned by the assignee hereof, a corner protector is detachably mounted on a forward edge of each of the sidewalls of the work implement loader bucket. The corner protector is mounted by means of a plurality of bolts. An interlocking tongue and groove arrangement mounts the corner protector on the sidewall. In one form, the corner protector is provided with a tip-adapter integrally secured on a lower end thereof.

In U.S. Pat. No. 4,007,550 of applicant, which patent is also owned by the assignee hereof, another replaceable corner tooth assembly is disclosed for use with an earthmoving implement having a sidewall member and a base plate member disposed in laterally extending relationship. The assembly includes a corner protector comprising an angle member and a rearwardly extending cooperating inner leg embracing the sidewall member. The corner member further embraces the base plate member at the forwardly disposed intersection thereof.

DISCLOSURE OF INVENTION

The present invention comprehends an improved wear member for use in an earthworking implement having a sidewall member defining a bottom edge portion to which the wear member is secured. The wear member of the present invention comprises a U-section member defining a bottom bight portion and spaced legs defining a channel receiving the lower end of the sidewall member.

Removable securing means are provided for removably securing the U-section member to the sidewall member to define a readily replaceable wear member thereon.

In the illustrated embodiment, the removable securing means comprise pins extending through the legs of the wear member and the bottom edge portion of the sidewall member.

The pins may be locked against axial displacement by suitable retaining means, such as a pair of locking rings.

The locking rings may be received in inwardly opposed recesses of the legs of the wear member.

A heavy wear member may be secured to the front edge of the sidewall member above the U-section member.

The heavy wear member means may include a half arrow element defined by an outer plate section having a front portion and a rear portion, and an inner, tapered section integral with the plate section front portion and widening rearwardly to a transverse shoulder surface. The half arrow element is welded to the sidewall member front edge portion by a weld disposed between the shoulder surface and the front edge of the sidewall member.

The rear portion of the half arrow element overlies an outer face of the sidewall member to provide further rigidity in the mounting thereof.

The front edge portion of the sidewall member defines a forwardly opening recess, the inner tapered section of the half arrow element being disposed within the recess.

The U-section member bottom bight portion defines a downwardly tapered lower surface for improved blade penetration.

The outer leg of the U-section member may extend forwardly a greater distance than the inner leg and the bit support may extend across the front of the inner leg into abutment with the inner side of the forwardly extending outer leg.

In the illustrated embodiment, the outer leg defines an inwardly and forwardly opening recess receiving the end of the bit support.

The forward extension of the outer leg may be substantially equal to the thickness of the bit support whereby the bit support extends substantially flush with the forwardmost surface of the U-shaped member.

The implement may include an end bit secured to the bit support and overlying the front faces of the bit support and the outer leg of the U-shaped member.

The improved wear member of the present invention is extremely simple and economical of construction while yet providing the highly desirable features discussed above.

BRIEF DESCRIPTION OF DRAWING

FIG. 1 is an exploded view of an earthworking implement having an improved wear member embodying the invention;

FIG. 2 is a perspective view of the wear member;

FIG. 3 is a side elevation of the earthworking implement;

FIG. 4 is a fragmentary front elevation thereof with the end bit being shown in broken lines;

FIG. 5 is a fragmentary horizontal section taken substantially along the line 5—5 of FIG. 3;

FIG. 6 is a horizontal section taken substantially along the line 6—6 of FIG. 3;

FIG. 7 is an enlarged vertical section taken substantially along the line 7—7 of FIG. 3; and FIG. 8 is a fragmentary enlarged vertical section taken substantially along the line 8—8 of FIG. 3.

BEST MODE FOR CARRYING OUT THE INVENTION

In the exemplary embodiment of the invention as disclosed in the drawing, an earthworking element generally designated 10 is illustratively shown to comprise a bulldozer blade, it being understood that the invention is equally applicable to other forms of earthworking elements, such as loader buckets, etc. Illustratively, the bulldozer blade includes a mold board 20, a pair of sidewalls 11 and 12 comprising plate member secured to the opposite sides of the mold board. Each of the end wall plates defines a forwardly opening recess 13 and a lower edge portion 14. The present invention is concerned with the reinforcing of the end wall members and includes a number of improved reinforcing elements, as will be discussed in greater detail herefollowing.

More specifically, lower edge portion 14 of the sidewall members is reinforced by an improved U-section wear member 15. The sidewall members are reinforced further by a half arrow reinforcing element 16 received in recess 13. The sidewall member rearwardly of the heavy wear member 17 is further reinforced by a wear plate 18.

As further shown in FIG. 1, the earthworking implement 10 includes a bit support 19 extending between the sidewall members at the lower edge of the moldboard 20. A plurality of bits generally designated 21 are mounted to the bit support 19 by suitable means, such as bolts (not shown). The bits include end bits 22 which overlap the U-section wear member 15 and sidewall member lower portions 14, as shown in FIG. 5.

The configuration of wear member 15 may best be seen by reference to FIG. 2. As shown therein, the wear member 15 comprises a U-section element having an outer leg 23, an inner leg 24, and a lower bight portion 25 cooperatively defining a slot 48. As shown, the outer leg 23 has a height substantially greater than the inner leg 24 and extends forwardly of the front surface 26 of the inner leg. In the illustrated embodiment, the outer leg 23 is provided with a forwardly and inwardly opening recess 27 adapted to receive the distal end 28 of the end bit support 19 and accommodate a weld 19*a* between edge portions 14 and end bit support 19, as shown in FIG. 5.

The forward extension of the outer leg 23 is substantially equal to the thickness of the bit support 19, as shown in FIG. 5. Thus, as illustrated in broken lines in FIG. 4, the end bit 22 may bear against the front surface 29 of the extension 30 of the outer leg 23 to extend to outwardly of wear member 15.

As shown in FIGS. 7 and 8, lower edge portion 14 of sidewall member 11 extends downwardly between legs 23 and 24 of the wear member. Leg 23 is provided with a pair of openings 31 and end wall portion 14 is provided with a corresponding pair of openings 32 for receiving a pair of locking pins 33 (FIGS. 1 and 2). As shown in FIG. 8, the locking pins extend further into aligned openings 34 in the inner leg 24 of the wear member 15. A pair of locking rings 35 may be provided for locking the pin 33 against axial displacement. As shown in FIG. 8, the locking rings, when utilized, are received in suitable grooves 36 in the locking pin 33 and are disposed within opposed, inwardly facing recesses 37 of the legs 23 and 24, permitting the locking rings to snap into place in the grooves 36 upon insertion of the locking pin 33 through the aligned openings. Thus, the wear member 15 may be readily removably secured to the lower edge portion 14 of the sidewall plates 11 and 12.

As indicated above and as shown in FIGS. 3 and 6, the sidewall plates are further reinforced by half arrow elements 16. Each element 16 is defined by an outer plate section 38 having a front portion 39 and a rear portion 40. An inner tapered section 41 is formed integrally with the plate section front portion 39 and widens rearwardly to a transverse shoulder surface 42. A weld 43*a* is provided rearwardly of surface 42 and forwardly of the front edge 44 of the sidewall plate defining the recess 13. Thus, the weld 43*a* is effectively recessed behind the wedge-shaped portion 41 for protection thereof during use of the earthworking element. A similar weld 43*b* is provided at the rear end of plate 38 for securing the plate thereat to sidewall plate 11, as seen in FIG. 6. As shown, weld 43*b* is protected against wear by the element 16.

As shown in FIG. 6, the rear portion 40 of the outer section 38 overlies the outer surface of the sidewall to provide further rigidification of the sidewall plates. The forward tip 45 of the half arrow element defines a relatively sharp leading edge portion of the half arrow element for improved penetration.

As seen in FIG. 7, plate 18 and end wall plate portion 14 have a cumulative thickness substantially equal to the cumulative width of slot 48 and outer leg 23 of the wear member 15. Wear plate 18 has a thickness substantially similar to that of the thickness of outer leg 23 of the wear member 15 and, thus, as seen in FIG. 7, the outer surfaces of the wear member 15 and replaceable wear plate 18 are substantially flush for further improved earthworking operation and improved wear life.

As seen in FIG. 2, the rear wall 46 of the wear member 15 extends between the legs 23 and 24 and has a height substantially equal to the height of the outer leg 23 so as to define a rear abutment for the sidewall plate portion 14. As shown in FIGS. 7 and 8, the lower surface 47 of bight 25 of wear member 15 is tapered downwardly so as to effectively define a V-section surface to provide a reduced footprint and better blade penetration during use of the earthworking implement.

As the wear member 15 is secured to the lower edge portion 14 of the sidewall plate members by pin means rather than welding means, the wear member may be formed as a casting of wear-resistant alloy steel providing further improved long troublefree life of the earthworking implement.

INDUSTRIAL APPLICABILITY

The use of the improved readily replaceable wear member 15 provides a substantial improvement in the facilitated maintenance of such earthworking implements. In the prior art constructions wherein heavy wear plates were welded on the sidewall members, the difficulty of replacement of the wear plates caused the shoe wear to be ignored until the end bit retention became a serious problem. By providing the improved readily replaceable U-section wear members 15, the rapid wear of the leading edge of the sidewall plates and lower shoe member has been effectively minimized so as to provide substantially improved usefulness with effectively minimum maintenance of the earthworking implement. As the shoe member may be readily replaced, only a short down time is required to effect the change from a worn member to a replacement member. As indicated above, as the wear member is mechanically secured to the earthworking implement, a long life wear-resistant alloy steel material may be utilized, further minimizing maintenance requirements.

The improved reinforcing means may be utilized in a wide range of earthworking implements, including the bulldozer blade implement of the disclosed embodiment, as will be obvious to those skilled in the art.

The improved structural integrity of the earthworking element utilizing the reinforcing means of the present invention is extremely simple and economical of construction while yet providing the highly desirable features discussed above.

Other aspects, objects and advantages of this invention can be obtained from a study of the drawings, the disclosure and the appended claims. The foregoing disclosure of specific embodiments is illustrative of the broad inventive concepts comprehended by the invention.

I claim:

1. In an earthworking implement (10) having a sidewall member (11,12) defining a bottom edge portion (14), wear member structure comprising:

a U-section member (15) defining a bottom bight portion (25), and spaced legs (23,24) extending upwardly from said bottom bight portion to define a channel (48) receiving said sidewall member bottom edge portion (14), and front edge portions;

securing means (33,35) removably securing said U-section member to said sidewall member to define a replaceable wear member thereon; and a transverse member extending across one of said front edge portions of the U-section member and the bottom edge portion of the sidewall member into abutment with the other of said front edge portions of the U-section member.

2. The earthworking implement of claim 1 wherein said securing means comprises at least one securing element (33) extending through at least one leg (23,24) of said U-section member and its said sidewall member (11,12).

3. The earthworking implement of claim 1 wherein said securing means comprises at least one securing element (33) extending through at least one leg (23,24) of said U-section member and its said sidewall member (11,12) bottom edge portion (14).

4. The earthworking implement of claim 1 wherein said securing means comprises at least one securing element (33) extending through said sidewall member (11,12) and having opposite spaced portions received in said U-section member legs (23,24).

5. The earthworking implement of claim 1 wherein said securing means comprises at least one securing element (33) extending through said sidewall member bottom edge portion (14) and having opposite spaced portions received in said U-section member legs (23,24).

6. The earthworking implement of claim 1 wherein said securing means comprises at least one securing element (33) extending through said sidewall member (11,12) and having opposite spaced portions received in said U-section member legs (23,24), and means (35,36) for preventing axial displacement of said at least one securing element.

7. The earthworking implement of claim 1 wherein said securing means comprises at least one securing element (33) extending through said sidewall member (11,12) and having opposite spaced portions received in said U-section member legs (23,24), and locking ring means (35,36) for preventing axial displacement of said at least one securing element.

8. The earthworking implement of claim 1 wherein said securing means comprises at least one securing element (33) extending through said sidewall member (11,12) and having opposite spaced portions received in said U-section member legs (23,24), and a pair of locking rings (35) embracing said at least one securing element (33) one each at opposite sides of said sidewall member (11,12).

9. The earthworking implement of claim 1 wherein said securing means comprises at least one securing element (33) extending through said sidewall member (11,12) and having opposite spaced portions received in said U-section member legs (23,24), and a pair of locking rings (35) embracing said at least one securing element (33) one each at opposite sides of said sidewall member (11,12), said legs (23,24) defining inwardly opposed recesses (37) for receiving said locking rings (35).

10. In an earthworking implement (10) having a sidewall member (11,12) defining a bottom edge portion (14), a wear member (15) comprising:

a U-section member (15) defining a bottom bight portion (25), and spaced legs (23,24) extending upwardly from said bottom bight portion to define a channel (48) receiving said sidewall member bottom edge portion (14); and securing means (33,35) removably securing said U-section member to said sidewall member to define a replaceable wear member thereon, one of said legs (23) having a length substantially greater than the other of said legs (24).

11. In an earthworking implement (10) having a shidewall member (11,12) defining a bottom edge portion (14) and a front edge portion (44) extending upwardly from said bottom edge portion (14), a wear member (15) comprising:

a U-section member (15) defining a bottom bight portion (25), and spaced legs (23,24) extending upwardly from said bottom bight portion to define a channel (48) receiving said sidewall member bottom edge portion (14);

securing means (33,35) removably securing said U-section member to said sidewall member to define a replaceable wear member thereon; and a wear plate (18) overlying said sidewall member bottom edge portion (14) and one of said U-section member legs (23), the other of said legs underlying an open space at one side of said sidewall bottom edge portion.

12. The earthworking implement (10) of claim 11 wherein said wear plate (18) has a thickness substantially equal to the thickness of said one leg (23).

13. The earthworking implement (10) of claim 11 wherein said wear member means includes a half arrow element (16) defined by an outer plate section (38) having a front portion (39) and a rear portion (40), and an inner tapered section (41) integral with said plate section front portion (39) and widening rearwardly to a transverse shoulder surface (42), said half arrow element being welded to said sidewall member front edge portion (44) by a weld (43) between said shoulder surface (42) and said front edge portion (44) with said rear portion (40) of the half arrow element overlying an outer face of the sidewall member (11,12).

14. The earthworking implement (10) of claim 11 wherein said sidewall member front edge portion (44) defines a forwardly opening recess (13) and said wear member means (15) includes a half arrow element (16) defined by an outer plate section (38) having a front portion (39) and a rear portion (40), and an inner tapered section (41) integral with said plate section front portion (39) and widening rearwardly to a transverse shoulder surface (42), said half arrow element being welded to said sidewall member front edge portion (44) by a weld (43) between said shoulder surface (42) and said front edge portion (44) with said rear portion (40) of the half arrow element overlying an outer face of the sidewall member (11,12), said inner tapered section (41) of said half arrow element being disposed within said recess (13).

15. In an earthworking implement (10) having a sidewall member (11,12) defining a bottom edge portion

(14) and a front edge portion (44) extending upwardly from said bottom edge portion (14), a wear member (15) comprising:

a U-section member (15) defining a bottom bight portion (25), and spaced legs (23,24) extending upwardly from said bottom bight portion to define a channel (48) receiving said sidewall member bottom edge portion (14);

securing means (33,35) removably securing said U-section member to said sidewall member to define a replaceable wear member thereon; and a wear plate (18) overlying said sidewall member bottom edge portion (14) and one of said U-section member legs (23), said one of said legs (23) being substantially thicker than the other of said legs (24) and said wear plate (18) overlying only said thicker leg (23).

16. The earthworking implement (10) of claim 15 wherein said wear plate (18) has a thickness substantially equal to the thickness of said thicker leg (23).

17. In an earthworking implement (10) having a sidewall member (11,12) defining a bottom edge portion (14), a wear member (15) comprising a U-section member (15) defining a bottom bight portion (25) defining a downwardly tapered lower surface (47), and inner and outer spaced legs (23,24) extending upwardly from said bottom bight portion to define a channel (48) receiving said sidewall member bottom edge portion (14), said outer leg (23) extending forwardly a greater distance than does said inner leg (24), and said implement including a bit support (19) extending across the front of said inner leg and having an end (28) abutting the inner side of the extension (30) of said forwardly extending outer leg (23).

18. The earthworking implement of claim 17 wherein said outer leg (23) defines an inwardly and forwardly opening recess (27) receiving said end (28) of the bit support (19).

* * * * *